US005414584A

United States Patent [19]

Young

[11] Patent Number: 5,414,584

[45] Date of Patent: May 9, 1995

[54] CIRCUIT BREAKER ENCLOSURE GAS VENTING SYSTEM

[75] Inventor: Michael S. Young, Cincinnati, Ohio

[73] Assignee: Square D Company, Palatine, Ill.

[21] Appl. No.: 74,252

[22] Filed: Jun. 9, 1993

[51] Int. Cl.[6] ..... H01H 9/00

[52] U.S. Cl. ..... 361/115; 361/93; 361/110

[58] Field of Search ..... 361/115, 117, 93, 78, 361/641, 658, 110; 200/50

[56] References Cited

U.S. PATENT DOCUMENTS 3,936,703 2/1976 Sakshaug ..... 361/117

4,194,100 3/1980 Cox et al. ..... 200/50

*Primary Examiner*—Marc S. Hoff

*Assistant Examiner*—S. Jackson

*Attorney, Agent, or Firm*—Larry I. Golden; David R. Stacey

[57] ABSTRACT

The present invention discloses a gas venting system for use in metallic enclosures housing electrical circuit breakers of the type having gas vents in the circuit breaker case for venting gases produced during the interruption of a fault current. The enclosure includes one or more covers which provide access to the interior of the enclosure and one or more vents through which the circuit breaker gases can exit the enclosure. The gas venting system includes a gas chute made from an electrically nonconductive and substantially flame retardant material. The gas chute is generally tubular and hollow in shape and has a breaker end aperture and at lease one vent end aperture. The apertures communicate with one another through the hollow gas chute. The gas chute is attached to an inside surface of the breaker enclosure such that when the enclosure cover is closed the breaker end aperture is in close proximity to and encloses the circuit breaker gas vents and the vent end aperture is in close proximity to and encloses the enclosure vents. Any gases produced by the circuit breaker during the interruption of a fault current and exiting through the gas vents in the breaker case must enter the gas chute through the breaker end aperture. The gas is then directed to the vent end aperture where it exits the enclosure through the enclosure vents.

10 Claims, 5 Drawing Sheets

CIRCUIT BREAKER ENCLOSURE GAS VENTING SYSTEM

FIELD OF THE INVENTION

This invention relates to circuit breakers enclosures and more specifically to the venting of gases produced by the circuit breaker during the interruption of a fault current from the circuit breaker enclosure.

BACKGROUND OF THE INVENTION

It is common practice to enclose a circuit breaker within a protective enclosure to prevent contact with live electrical conductors and to provide physical protection for the circuit breaker and its operating mechanism. It is desirable to keep the physical size of the circuit breaker enclosure as small as possible. However, when the circuit breaker interrupts a fault current it produces a large volume of hot gases which are expelled rapidly through vents in the circuit breaker case directly into the circuit breaker enclosure. These gases may be of sufficient volume and force to cause physical damage to the breaker enclosure if the pressure inside the enclosure becomes excessive. The amount of gas produced and the speed and temperature at which it is expelled from the breaker increases proportionally with the magnitude of the fault current interrupted. Under high fault current conditions, the gases can be produced and expelled at such a high speed that a shock wave is produced within the enclosure. The increased pressure produced by this shock wave may be of sufficient strength to rupture the enclosure causing an unsafe operating condition. The arc initiated by the electrical contacts opening on a high fault current can also cause some melting of the electrical contacts and arc quenchers within the breaker case and ignition of the gases may occur. Some small particles of molten metal from the breaker contacts and arc quenchers may be expelled through the vents in the breaker casing along with the burning gases. These small molten metal particles combined with the high volume of hot electrically conductive gases may cause a ground fault or a phase to phase fault of the line conductors within the enclosure. It is common to provide vents in the breaker enclosure to allow the circuit breaker gases to exit and thereby reduce the internal pressure of the enclosure. However, the size and location of these enclosure vents are generally governed by electrical codes and third party certification requirements. These requirements generally specify that access to live parts within the enclosure cannot be obtained through the vent and that no flame or molten metallic particles can exit the enclosure through the vent. To meet these requirements, the vent size and location may be restricted such that breaker gases cannot exit the breaker enclosure at a speed sufficient to prevent damage to the enclosure. It is therefore of great importance that a direct path of adequate size be provided such that the hot conductive gases may exit the breaker enclosure rapidly and safely without causing physical damage to the enclosure. It is also important that this path be electrically insulated such that any molten metal particles are prevented from striking grounded uninsulated metal parts of the enclosure causing a ground fault or from striking live parts causing a phase to phase fault within the enclosure. The path must also be significantly flame retardant such that any flames exiting the breaker case are contained within the path and the enclosure. The path must contain the molten metal particles and flames while at the same time allowing the gas pressure to within the enclosure to be relieved at a rate sufficient to prevent damage to the enclosure.

SUMMARY OF THE INVENTION

The present invention provides an electrically insulated and substantially flame retardant gas chute for permitting the high volume of gases produced by a circuit breaker during the interruption of a high fault current to safely exit the circuit breaker enclosure while at the same time containing any flames and molten metal particles expelled by the circuit breaker safely within the gas chute. The gas chute is attached to an inside surface of the circuit breaker enclosure such that one end of the chute is in close proximity to the vents in the circuit breaker casing and the other end surrounds vents provided in the circuit breaker enclosure. The gas chute contains and guides the hot breaker gases expelled from the circuit breaker directly from the circuit breaker casing vents to vents in the breaker enclosure. A nonconductive substantially flame retardant mesh-like spark/flame arrestor covers the inside surface of the breaker enclosure vents preventing any of the molten metallic particles from striking conductive parts of the breaker enclosure and preventing any flame from exiting the breaker enclosure. By containing and directing the breaker gases directly from the circuit breaker to the enclosure vents, the pressure inside the breaker enclosure is not allowed to build up to a critical point. Since the electrically insulated gas chute prohibits access to live parts within the breaker enclosure, the enclosure vents may be of sufficient size to pass a large volume of gas in a short period of time and thereby prevent a pressure build-up within the breaker enclosure.

Other features and advantages of the invention will become apparent to those skilled in the art upon review of the following detailed description, claims and drawings.

Figure 1:
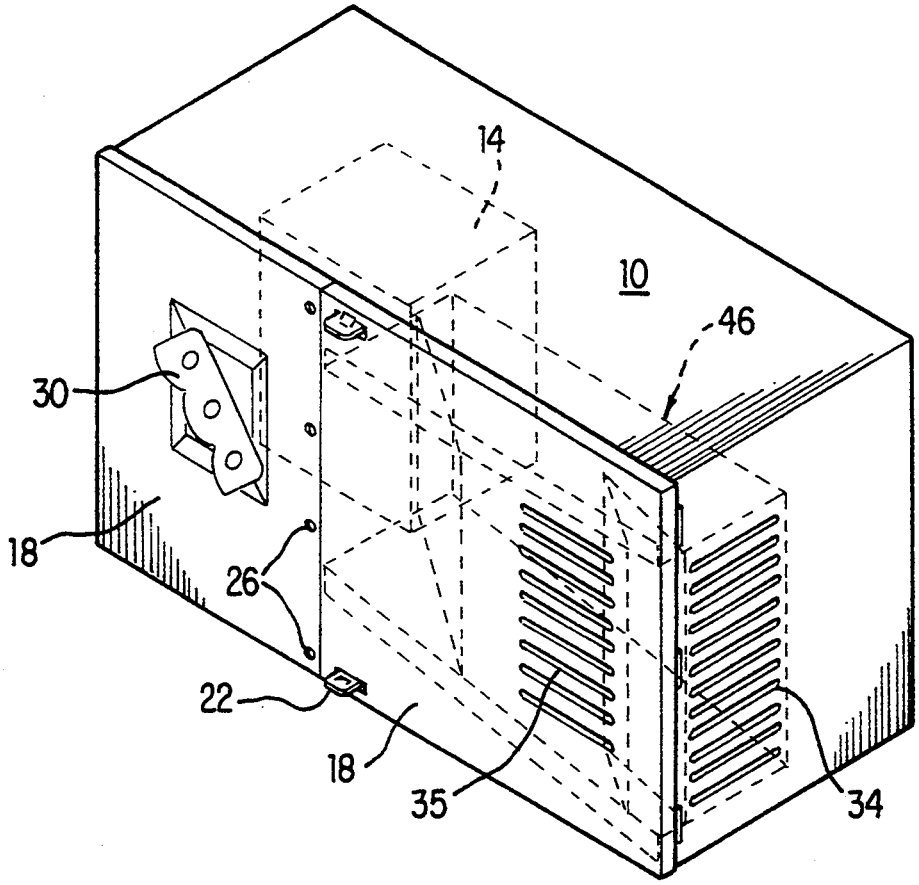
FIG. 1 is an isometric view of the exterior of a circuit breaker enclosure with a gas chute of the present invention and a circuit breaker having gas vents at the load end of the breaker case shown in phantom.

Before one embodiment of the invention is explained in detail, it is to be understood that the invention is not limited in its application to the details of construction and description or illustrated in the drawings. The invention is capable of other embodiments and of being practiced or being carried out in various other ways. Also, it is to be understood that the phraseology and terminology used herein is for the purpose of description and should not be regarded as limiting.

DESCRIPTION OF THE PREFERRED EMBODIMENT

A circuit breaker enclosure 10 of a type commonly used to enclose a circuit breaker 14 is illustrated in FIG. 1. The enclosure 10 includes one or more hinged covers 18 which provide access to the enclosed circuit breaker 14 for the purpose of making electrical connections. The covers 18 are secured in the closed position by suitable means such as latches 22 or screws 26. An external breaker operator 30 is generally mounted on one of the covers 18. Enclosure vents 34 and 35 provide a means for permitting the breaker gases produced during the interruption of a fault current to exit the enclosure 10.

Figure 3:
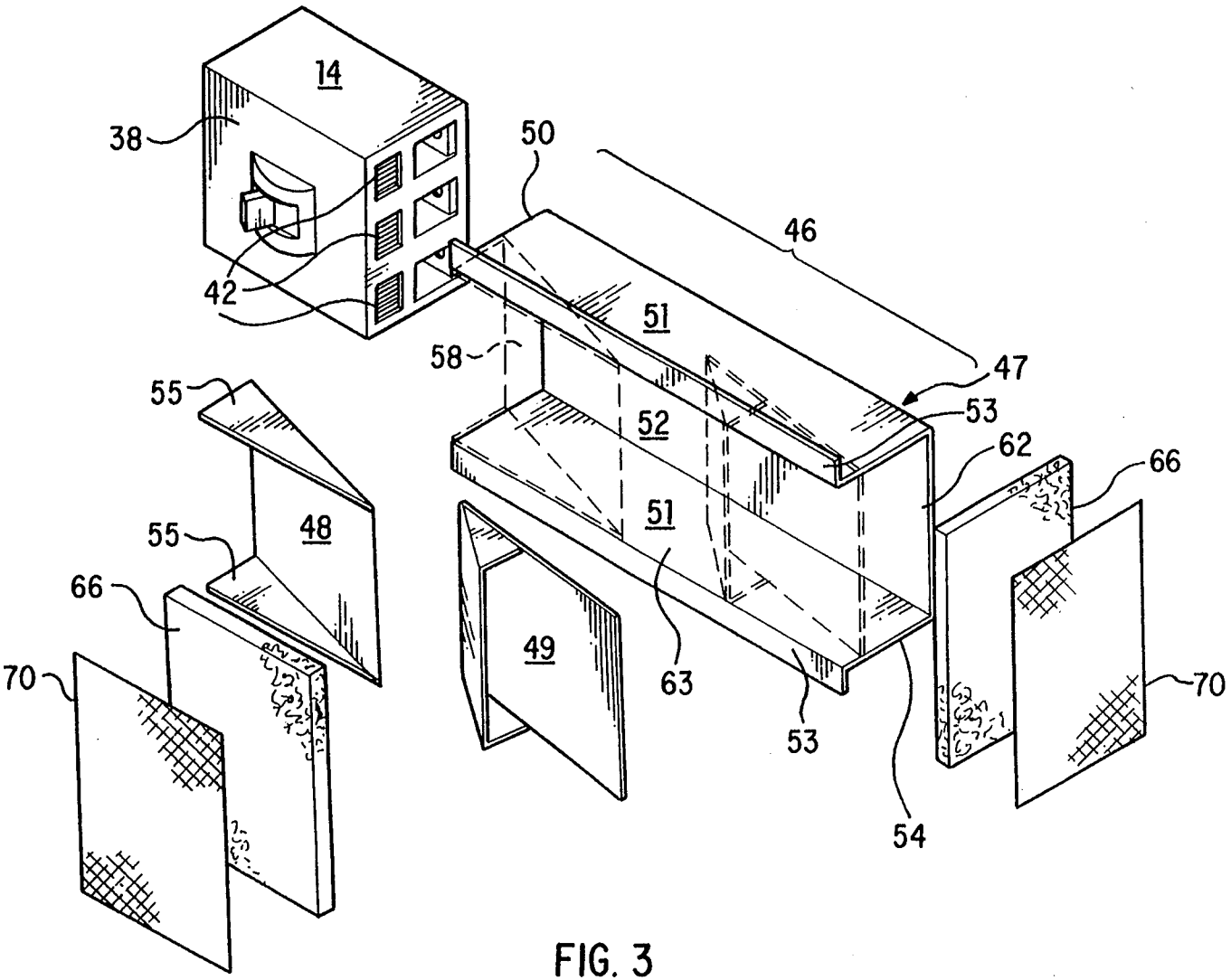
FIG. 3 is an exploded view illustrating a gas chute constructed in accordance with the present invention, showing the spark/flame arrestor and screen in relationship to a circuit breaker having gas vents at the load end of the circuit breaker case.

Referring now to FIG. 3, a circuit breaker 14 of the type normally enclosed within the enclosure 10 is shown. The circuit breaker 14 has a molded case 38 which surrounds the electrical components of the breaker 14. The case 38 includes a vent 42 for each electrical phase of the breaker 14. The vents 42 allow breaker gases produced during the interruption of a fault current to exit the breaker case 38. The vents 42 are located near the breaker contacts and may be in any convenient surface of the breaker case 38. Also shown in FIG. 3 is a gas chute 46 of the present invention. The gas chute 46 is made from an electrically insulating and substantially flame retardant material such as General Electric's Lexan and generally defines a hollow enclosure. As illustrated in FIG. 3, the gas chute 46 is made from three parts, a cover 47, a restricting plate 48, and a baffle 49. The cover 47 has two outwardly extending legs 51 spaced apart by an intermediate web 52 forming a generally U-shaped cross-section. An outwardly extending flange 53 runs along each of the extended ends of the legs 51 and provide a suitable means for attaching the gas chute 46 to the circuit breaker enclosure cover 18 shown in FIG. 1. The restricting plate 48 is generally rectangular in shape. Attachment tabs 55 extend from two opposite edges of the restricting plate 48 at approximately 90° to the surface of the restricting plate 48. The width of the restricting plate 48 between the attachment tabs 55 is such that the tabs 55 are slidably received between the two spaced apart legs 51 of the cover 47 of the gas chute 46. The attachment tabs 55 provide suitable means for attaching the restricting plate 48 to the cover 47 using attachment means such as rivets or welding. When the circuit breaker enclosure cover 18 is closed, the gas chute 46 is in its normal operating position. The gas chute 46 includes a breaker end 50 and a vent end 54 opposite the breaker end 50. A breaker end aperture 58 is formed by the cover 47 and the restricting plate 48 such that the aperture 58 is dimensioned to cover all of the breaker vents 42. The vent end 54 has two vent end apertures 62 and 63 formed by the cover 47, the baffle 49, and the restricting plate 48. Vent end aperture 62 and 63 coincide with and completely enclose the enclosure vent sections 34 and 35, respectively, of the enclosure 10.

Figure 2:
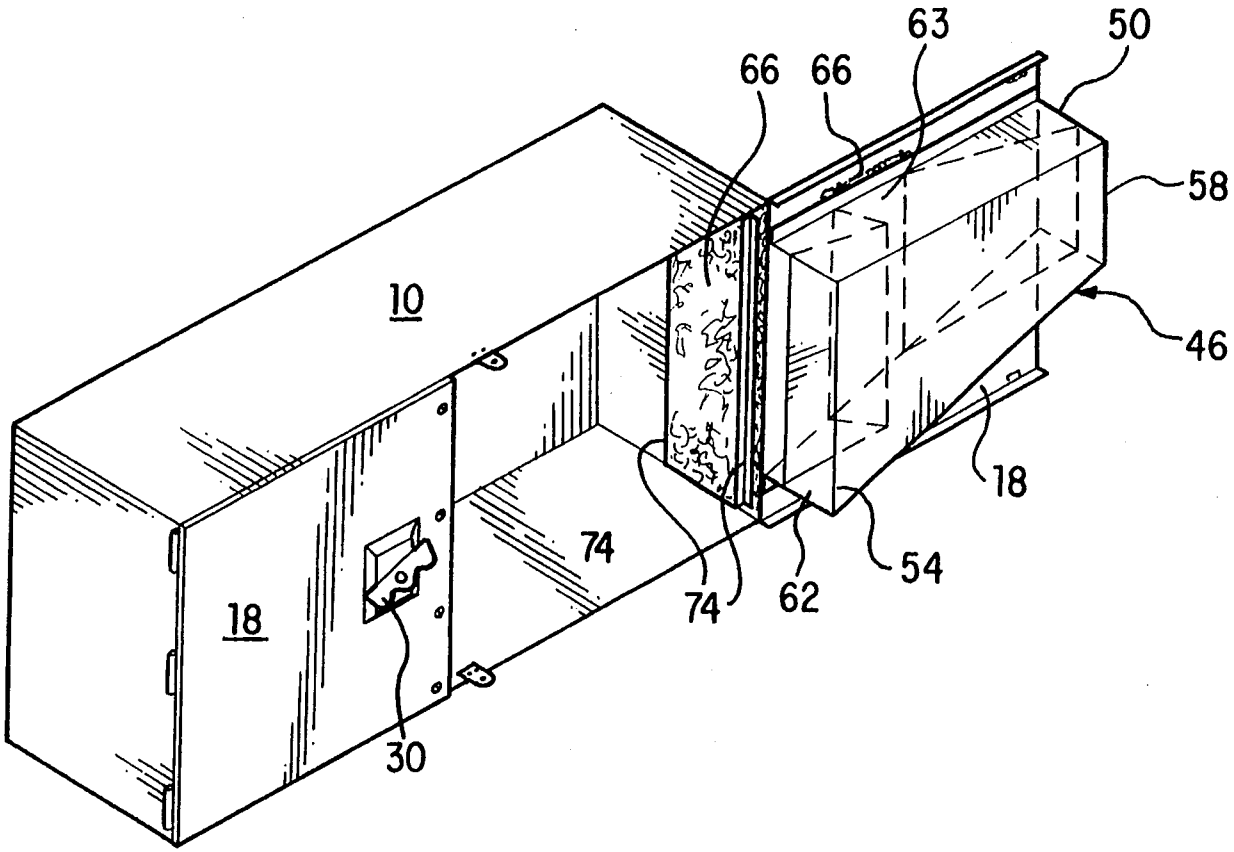
FIG. 2 is an isometric view of a circuit breaker enclosure with the access door open, illustrating a gas chute of the embodiment of the present invention illustrated in FIG. 1 installed on the access door with spark/flame arrestors installed over the enclosure vents.

Referring now to FIGS. 2 and 3, an electrically nonconductive and substantially flame retardant spark/flame arrestor 66 completely covers each vent end aperture 62. These spark/flame arrestors 66 protect the inside surface of each enclosure vent 34 from strikes by molten metallic particles produced by arcing electrical contacts and expelled through the breaker vents 42 during the interruption of a fault current. The spark/flame arrestors 66 also prevent any flames from ignited breaker gases from exiting the enclosure 10 through the enclosure vents 34 and 35. A nonconductive screen material 70 is placed between each spark/flame arrestor 66 and the enclosure vent 34 to prevent the spark/flame arrestors 66 from protruding through the enclosure vents 34 and 35 and to prevent foreign objects from entering the gas chute 46 through the enclosure vents 34 and 35. The spark/flame arrestor 66 and the screen 70 are secured to the inside surface of the enclosure 10 by suitable means such as brackets 74 such that they completely cover the enclosure vent 34. The spark/flame arrestor 66 and screen 70 covering the enclosure vent 35 in the enclosure cover 18 is held in place by the gas chute 46. According to the present invention the spark/flame arrestor 66 is a mesh-like material product of the F. P. Woll & Co. of Philadelphia, Pa. and the screen 70 is a thermoglass cloth product of AMATEX Corporation of Norristown, Pa.

Referring again to FIG. 1, it can be seen that when the cover 18 is closed and secured, the breaker end 50 is positioned in close proximity to the vents 42 in the breaker case 38 and the vent end 54 is positioned in close proximity to the inside surface of the enclosure 10 such that the vent end apertures 62 and 63 surround and enclose the enclosure vents 34 and 35. Any breaker gases exiting the breaker case 38 through vents 42 must enter the gas chute 46 through the breaker end aperture 58. The gas chute 46 then directs the breaker gases directly from the breaker vents 42 to the enclosure vents 34 and 35.

Figure 4:
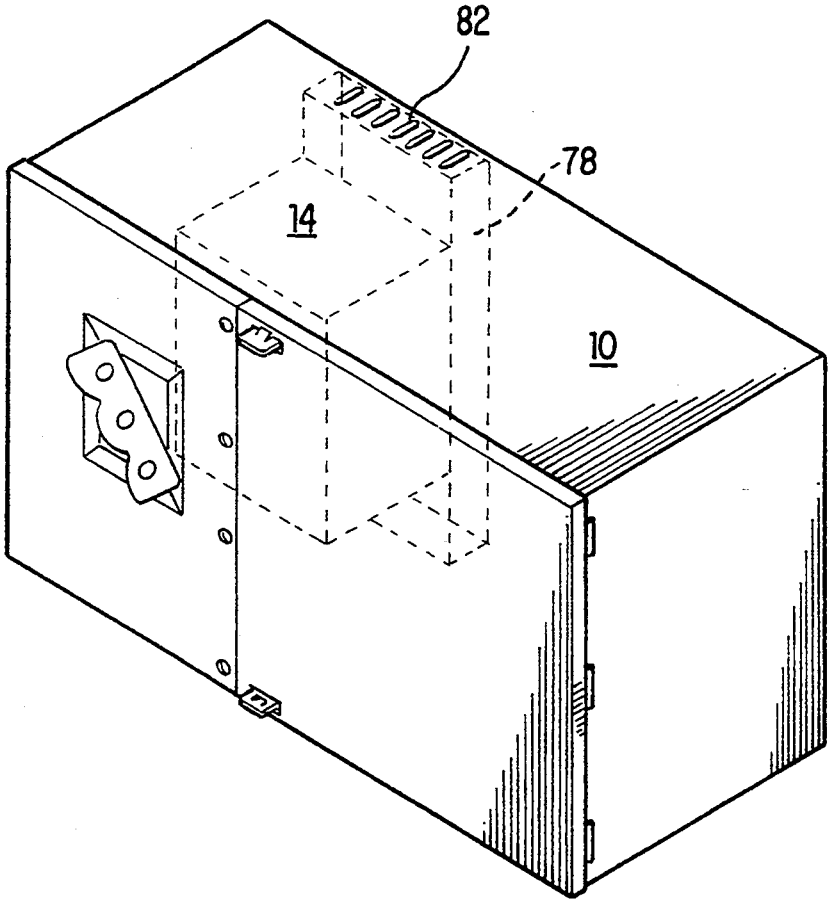
FIG. 4 is an isometric view of the exterior of a circuit breaker enclosure with a gas chute of the present invention and a circuit breaker having gas vents on the back surface of the breaker case shown in phantom.

FIG. 4 illustrates a second embodiment of the gas venting system of the present invention wherein the circuit breaker gas vents 42 are located in the back surface of the breaker case 38. A gas chute 78 is attached to an inside surface of the breaker enclosure 10 and operates in the same manner as in the previously described embodiment of the gas chute 46 shown in FIGS. 1–3. An enclosure vent 82 is placed in a convenient location such that the gas chute 78 may easily provide a path between it and the breaker gas vents 42.

Figure 5:
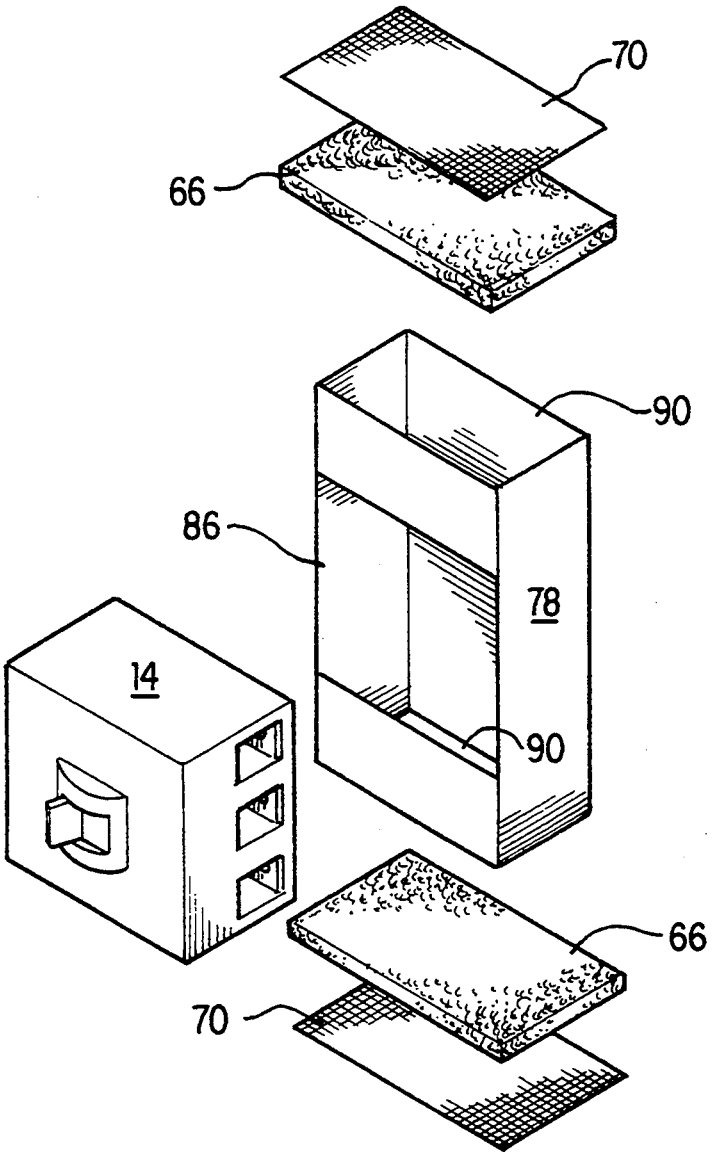
FIG. 5 is an exploded view illustrating a gas chute of the present invention showing the spark/flame arrestor and screen in relationship to a circuit breaker having gas vents in the bottom of the circuit breaker case.

The gas chute 78, as shown in FIG. 5, includes a breaker vent aperture 86 which surrounds and encloses the breaker gas vents 42 and at least one enclosure vent aperture 90 which surrounds and encloses each enclosure vent 82. The spark/flame arrestor 66 and screen 70 completely cover each enclosure vent aperture 90 to protect the inside surface of the enclosure vents 82 from strikes by molten metal and to prevent any flames from exiting the enclosure 10 through the enclosure vents 82 as discussed in the previously described embodiment.

I claim:

1. A gas venting system for a metallic enclosure housing an electrical circuit breaker of the type having gas vents in the circuit breaker case for expelling gases produced when the circuit breaker interrupts a fault current, and wherein the enclosure includes one or more covers providing access to the interior of the enclosure and vents through which the circuit breaker gases can exit the enclosure, said gas venting system comprising:

(a) a substantially hollow gas chute defining an interior volume and having a breaker end aperture and at least one vent end aperture, said breaker end aperture and said vent end aperture communicating with one another through said interior volume, said gas chute being attached to an inside surface of the breaker enclosure cover such that when the enclosure cover is closed said breaker end aperture is in a juxtaposed relationship with and encloses the circuit breaker gas vents and said vent end aperture is in a juxtaposed relationship with and encloses the enclosure vents such that any gas produced by the circuit breaker and expelled through the breaker gas vents must enter said gas chute through said breaker end aperture and thereby be directed to said vent end aperture where the gas exits the enclosure thorough the enclosure vents; and (b) means for attaching said gas chute to the inside surface of the circuit breaker enclosure cover.

2. The gas venting system of claim 1 wherein said gas chute is made from an electrically nonconductive and substantially flame retardant material.

3. The gas venting system of claim 2 further comprising a spark/flame arrestor, made from an electrically nonconductive material and being positioned between said vent end aperture of said gas chute and the inside surface of the enclosure such that said vent end aperture is completely covered by said spark/flame arrestor.

4. The spark/flame arrestor of claim 3 further comprising a generally mesh-like structure such that gases produced by the circuit breaker during the interruption of a fault current and expelled through the breaker gas vents may pass through said spark/flame arrestor while any metallic particles expelled through the circuit breaker gas vents are prohibited from striking the metallic enclosure by said spark/flame arrestor and any flame from ignited breaker gases cannot exit the breaker enclosure through the enclosure vents.

5. The gas venting system of claim 3 further comprising:

(a) a screen, made from an electrically nonconductive material and being placed between the inside surface of the breaker enclosure and said spark/flame arrestor such that the enclosure vent is completely covered, whereby said screen prevents said spark/flame arrestor from protruding though the enclosure vents and also prevents foreign objects from entering said gas chute through the enclosure vents; and (b) means for attaching said screen and said spark/flame arrestor to the inside surface of the enclosure.

6. A gas venting system for a metallic enclosure housing an electrical circuit breaker of the type having gas vents in the circuit breaker case for expelling gases produced when the circuit breaker interrupts a fault current, and wherein the enclosure includes one or more covers providing access to the interior of the enclosure and vents through which the circuit breaker gases can exit the enclosure, said gas venting system comprising:

(a) a gas chute defining a hollow interior and having a breaker vent aperture and at least one enclosure vent aperture, said breaker vent aperture and said enclosure vent aperture communicating with each other through said hollow interior, said gas chute being attached to an inside surface of the breaker enclosure such that said breaker vent aperture is in a juxtaposed relationship with and encloses the circuit breaker gas vents and said enclosure vent aperture is in a juxtaposed relationship with and encloses the enclosure vents such that any gas produced by the circuit breaker and expelled through the breaker vents must enter said gas chute through said breaker vent aperture and is thereby directed to said enclosure vent aperture where the gas exits the enclosure thorough the enclosure vents; and (b) means for attaching said gas chute to the inside surface of the circuit breaker enclosure.

7. The gas venting system of claim 6 wherein said gas chute is made from an electrically nonconductive and substantially flame retardant material.

8. The gas venting system of claim 7 further comprising a spark/flame arrestor, made from an electrically nonconductive material and being placed between said vent aperture of said gas chute and the inside surface of the enclosure such that said enclosure vent aperture is completely covered by said spark/flame arrestor.

9. The spark/flame arrestor of claim 8 further comprising a generally mesh-like structure such that gases produced by the circuit breaker during the interruption of a fault current and expelled through the breaker gas vents may pass through said spark/flame arrestor while any metallic particles expelled through the circuit breaker gas vents are prohibited from striking the metallic enclosure by said spark/flame arrestor and any flames from ignited breaker gases cannot exit the breaker enclosure through the enclosure vents.

10. The gas venting system of claim 8 further comprising:

(a) a screen, made from an electrically nonconductive material and being placed between the inside surface of the breaker enclosure and said spark/flame arrestor such that the enclosure vent is completely covered, whereby said screen prevents said spark/flame arrestor from protruding though the enclosure vents and also prevents foreign objects from entering said gas chute through the enclosure vents; and (b) means for attaching said screen and said spark/flame arrestor to the inside surface of the enclosure.

* * * * *